US011362435B2

(12) United States Patent
Baek et al.

(10) Patent No.: US 11,362,435 B2
(45) Date of Patent: Jun. 14, 2022

(54) ANTENNA ARRAY AND VEHICLE INCLUDING THE SAME

(71) Applicants: HYUNDAI MOTOR COMPANY, Seoul (KR); KIA MOTORS CORPORATION, Seoul (KR); IUCF-HYU (Industry-University Cooperation Foundation Hanyang University), Seoul (KR)

(72) Inventors: Jisoo Baek, Gwangmyeong-si (KR); Jaehoon Choi, Seoul (KR); Hojoo Lee, Seongnam-si (KR); Minbeom Ko, Seongnam-si (KR); Yeonjeong O, Seoul (KR)

(73) Assignees: HYUNDAI MOTOR COMPANY, Seoul (KR); KIA MOTORS CORPORATION, Seoul (KR); IUCF-HYU (Industry-University Cooperation Foundation Hanyang University), Seoul (KR)

( * ) Notice: Subject to any disclaimer, the term of this patent is extended or adjusted under 35 U.S.C. 154(b) by 0 days.

(21) Appl. No.: 17/096,562

(22) Filed: Nov. 12, 2020

(65) Prior Publication Data

US 2021/0194151 A1 Jun. 24, 2021

(30) Foreign Application Priority Data

Dec. 18, 2019 (KR) ..... 10-2019-0169658

(51) Int. Cl.

| | |
|---|---|
| ***H01Q 21/00*** | (2006.01) |
| ***H01Q 1/28*** | (2006.01) |
| ***H01Q 1/32*** | (2006.01) |
| ***H01Q 7/00*** | (2006.01) |

(52) U.S. Cl.

CPC ..... *H01Q 21/0068* (2013.01); *H01Q 1/283* (2013.01); *H01Q 1/3275* (2013.01); *H01Q 7/00* (2013.01); *H01Q 21/0018* (2013.01)

(58) Field of Classification Search

CPC ..... H01Q 21/00; H01Q 21/0068; H01Q 21/0018; H01Q 7/00; H01Q 1/283; H01Q 1/3275

See application file for complete search history.

(56) References Cited

FOREIGN PATENT DOCUMENTS

JP H0567912 A * 3/1993 ..... H01Q 13/10

* cited by examiner

*Primary Examiner* — Hoang V Nguyen

(74) *Attorney, Agent, or Firm* — Lempia Summerfield Katz LLC

(57) ABSTRACT

An antenna array has wideband high gain characteristics and includes: a dielectric; a loop provided on a first surface of the dielectric and that has a first slot and a second slot; a first feed pin provided at a position corresponding to the first slot on a second surface of the dielectric; a second feed pin provided at a position corresponding to the second slot on the second surface of the dielectric; and a divider provided between the first feed pin and the second feed pin, and electrically connected to the loop.

18 Claims, 12 Drawing Sheets

ANTENNA ARRAY AND VEHICLE INCLUDING THE SAME

CROSS-REFERENCE TO RELATED APPLICATION

This application is based on and claims priority under 35 U.S.C. § 119 to Korean Patent Application No. 10-2019-0169658, filed on Dec. 18, 2019 in the Korean Intellectual Property Office, the disclosure of which is incorporated herein by reference.

BACKGROUND

1. Field

The present disclosure relates to an antenna array and vehicle including the same, and more specifically, to an antenna array and vehicle comprising a plurality of independent single antennas.

2. Description of the Related Art

Existing commercial WiFi, Bluetooth, WiMax, IEEE 80211p-based short-range communication and 4G technology are limited in bandwidth. Therefore, there is a problem because it is difficult to process a large amount of data without delay, such as autonomous vehicle communication and three-dimensional and high-definition images of vehicle sensor systems.

Therefore, next-generation millimeter wave-based wireless communication technology with high transmission speed, object communication, and high reliability features is being applied to cellular-V2X communication to deliver a large amount of data without delay during autonomous vehicle driving. In particular, research on connected cars is actively conducted in the 28 GHz band.

Since the path loss is large in the millimeter wave band, it is necessary to develop an antenna having high gain characteristics.

In general, an antenna is a converter for transmitting or receiving electromagnetic waves in a specific area. The antenna converts and transmits an electric signal of an electromagnetic frequency band to an electromagnetic wave and vice versa.

Antennas are widely used in radio and television radios, radio and two-way communication devices, and radar and space probe radio telescopes.

Physically, an antenna is an arrangement of conductors that radiates the electromagnetic field into free space, which occurs when a voltage is applied with a modulated current. Alternatively, currents and voltages induced in the antenna are generated by the influence of electromagnetic fields.

Antennas may be classified into a dipole antenna, a monopole antenna, a patch antenna, a parabolic antenna, a helical antenna, a yagi antenna, a slot antenna, and an array antenna according to the shape thereof. In some occasions a required radiation pattern may not be obtained by a single antenna.

SUMMARY

If a radiation pattern that cannot be obtained by a single antenna is required, an array antenna in which pluralities of independent single antennas are arranged in a specific pattern may be used. By using such an array antenna, directivity is provided.

Therefore, it is an object of the present disclosure to provide an array antenna that has a wideband high gain characteristic.

Therefore, it is an aspect of the present disclosure to provide an antenna array that includes: a dielectric; a loop provided on a first surface of the dielectric that has a first slot and a second slot; a first feed pin provided at a position corresponding to the first slot on a second surface of the dielectric; a second feed pin provided at a position corresponding to the second slot on the second surface of the dielectric; and a divider provided between the first feed pin and the second feed pin, and electrically connected to the loop.

The divider may include: a stub provided between the first feed pin and the second feed pin on the second surface of the dielectric; and via holes that extend from both ends of the stub to the loop through the dielectric.

The loop may include a partition that partitions the first slot and the second slot.

The stub may be provided at a position corresponding to the partition.

The first feed pin may extend from a first point corresponding to the loop toward center of the first slot. The second feed pin may extend from a second point corresponding to the loop toward center of the second slot.

The first feed pin and the second feed pin may be disposed in parallel with each other.

The divider may include a stub provided in parallel with the first feed pin and the second feed pin.

It is an aspect of the present disclosure to provide an antenna array. The antenna array includes a dielectric, a first antenna, and a second antenna. The first antenna includes a first loop provided on a lower surface of the dielectric and having a first slot formed thereon and includes a first feed pin provided on an upper surface of the dielectric and provided at a position corresponding to the first slot. The second antenna includes a second loop provided on a lower surface of the dielectric and having a second slot formed thereon and includes a second feed pin provided on an upper surface of the dielectric and provided at a position corresponding to the second slot. The antenna array also includes a divider that separates the first antenna and the second antenna. At least a portion of the first loop may be shared with at least a portion of the second loop.

The divider may include: a stub provided between the first feed pin and the second feed pin on the second surface of the dielectric; and via holes that extend from both ends of the stub to the loop through the dielectric.

The stub may be provided at a position where the first loop and the second loop are shared.

The first feed pin may extend from a first point corresponding to the loop toward center of the first slot. The second feed pin may extend from a second point corresponding to the loop toward center of the second slot.

The first feed pin and the second feed pin may be disposed in parallel with each other.

The divider may include a stub provided in parallel with the first feed pin and the second feed pin.

It is an aspect of the present disclosure to provide a vehicle including a vehicle body and an antenna array spaced apart from the vehicle body by a predetermined distance. The antenna array may include: a dielectric; a loop provided on a first surface of the dielectric and having a first slot and a second slot; a first feed pin provided at a position corresponding to the first slot on a second surface of the dielectric; a second feed pin provided at a position corresponding to the second slot on the second surface of the dielectric; and a divider provided between the first feed pin and the second feed pin, and electrically connected to the loop.

The divider may include: a stub provided between the first feed pin and the second feed pin on the second surface of the dielectric; and via holes extending from both ends of the stub to the loop through the dielectric.

The loop may include a partition that partitions the first slot and the second slot.

The stub may be provided at a position corresponding to the partition.

The first feed pin may extend from a first point corresponding to the loop toward center of the first slot. The second feed pin may extend from a second point corresponding to the loop toward center of the second slot.

BRIEF DESCRIPTION OF THE DRAWINGS

These and/or other aspects of the disclosure should become apparent and more readily appreciated from the following description of the embodiments, taken in conjunction with the accompanying drawings of which.

DETAILED DESCRIPTION

Hereinafter, the operating principles and embodiments of the disclosure are described with reference to the accompanying drawings.

Further, when an element in the written description and claims is described as being "for" performing or carry out a stated function, step, set of instructions, or the like, the element may also be considered as being "configured to" do so.

Figure 1A:
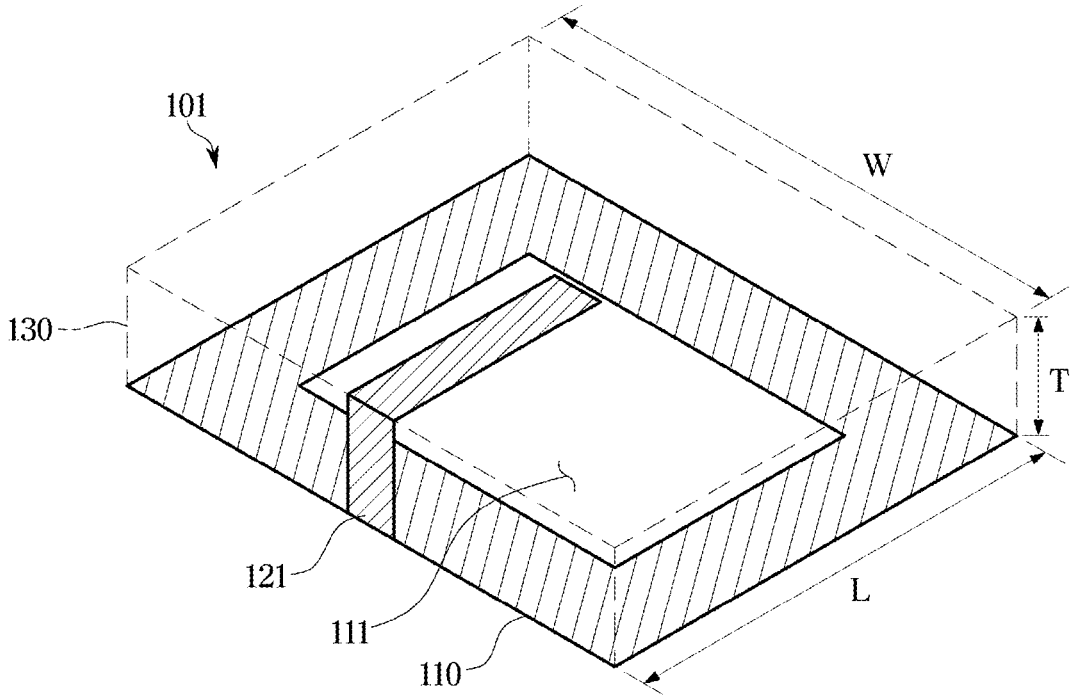
FIGS. 1*a* and 1*b* illustrate a slot loop antenna according to an embodiment.
Figure 1B:
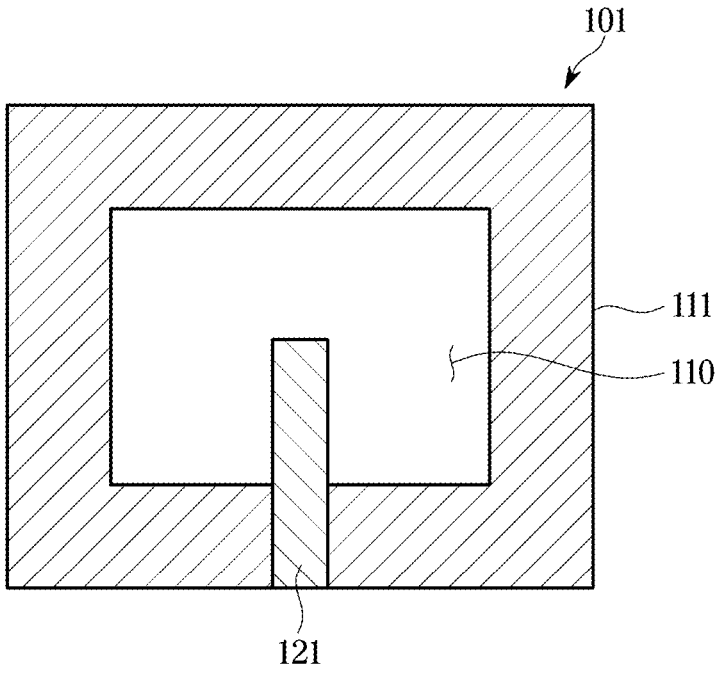

Referring to FIGS. 1*a* and 1*b*, the first slot loop antenna 101 includes: a loop 110 in which a slot 111 is formed; a feed pin 121 extending toward the center of the slot 111 from one side of the loop 110; and a dielectric 130 provided between the loop 110 and the feed pin 121.

The loop 110 has a substantially rectangular (or square) shape as shown in FIG. 1*a*. The center of the loop 110 is formed with a slot 111 and has a substantially rectangular (square) shape. As such, the loop 110 has the shape of a rectangular ring (or square ring) having a width W and a length L.

The width W and the length L of the loop 110 may depend on the frequency f or the wavelength λ of the electromagnetic waves emitted by the first slot loop antenna 101. For example, the width W and the length L of the first slot loop antenna 101 designed to radiate electromagnetic waves of approximately 28 Gigahertz (GHz) may be approximately 7.5 millimeter (mm) and approximately 6.7 mm.

The loop 110 may be made of a conductive material in which an electric field is generated and a current flows when a voltage is applied.

The dielectric 130 is provided between the feed pin 121 and the loop 110 as shown in FIG. 1*a*.

The thickness T of the dielectric 130 may depend on the wavelength λ. For example, the thickness T of the dielectric 130 of the first slot loop antenna 101 designed to radiate electromagnetic waves of approximately 28 GHz may be 1 mm.

In the dielectric 130, electromagnetic waves may be generated by the feed pin 121 and the loop 110. Electromagnetic waves generated in the dielectric 130 may radiate into free space.

The dielectric 130 may be composed of a dielectric material in which an electric field is generated and no current flows when a voltage is applied. The dielectric 130 may be, for example, a dielectric material having a dielectric constant of 2.2.

The feed pin 121 has a shape of a substantially pole-shaped monopole antenna.

The feed pin 121 is provided on the upper surface (opposite the loop) of the dielectric 130. The feed pin 121 is provided with a loop 110 on one surface of both surfaces of the dielectric 130.

The feed pin 121 extends from the edge of the loop 110 toward the center of the loop 110 (center of the slot) as shown in FIG. 1*b*. For example, the feed pin 121 may extend from the position corresponding to the center of the bottom side of the loop 110 toward the center of the top side. The feed pin 121 overlaps the bottom side of the loop 110 but may not overlap the top side of the loop 110.

The feed pin 121 may be formed of a conductive material in which an electric field is formed and a current flows when a voltage is applied.

The first slot loop antenna 101 may operate in two modes of operation. For example, the first slot loop antenna 101 may operate in a loop mode at approximately 28 GHz. In addition, the first slot loop antenna 101 may operate in a slot mode at approximately 38 GHz.

Figure 3:
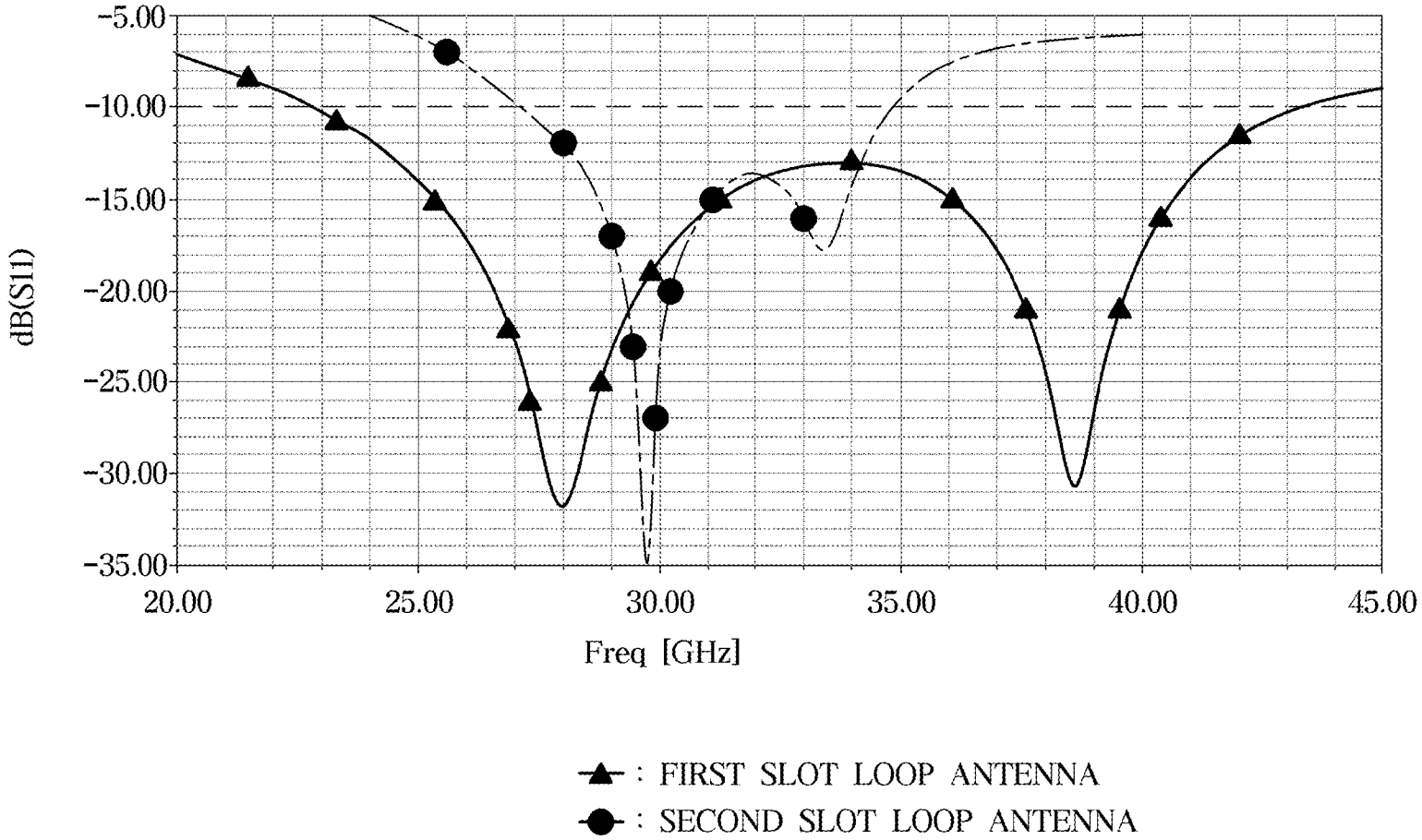
FIG. 3 shows the return loss of the slot loop antenna shown in FIG. 1 and the antenna assembly shown in FIGS. 2*a* and 2*b*.

As shown in FIG. 3, the first slot loop antenna 101 may have a minimum value of return loss S11 at approximately 28 GHz and approximately 38 GHz. In addition, the bandwidth of the first slot loop antenna 101 may be 20.51 GHz from about 22.83 GHz-43.34 GHz based on −10 dB.

Figure 2A:
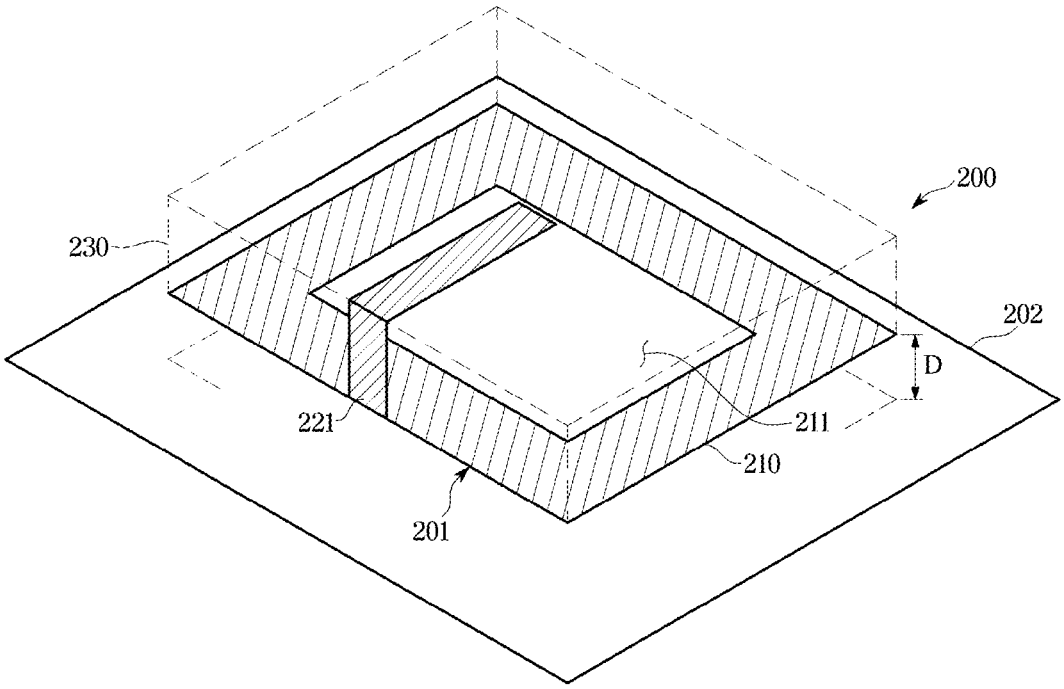
FIGS. 2*a* and 2*b* illustrate an antenna assembly including a slot loop antenna and a reflector according to an embodiment.
Figure 2B:
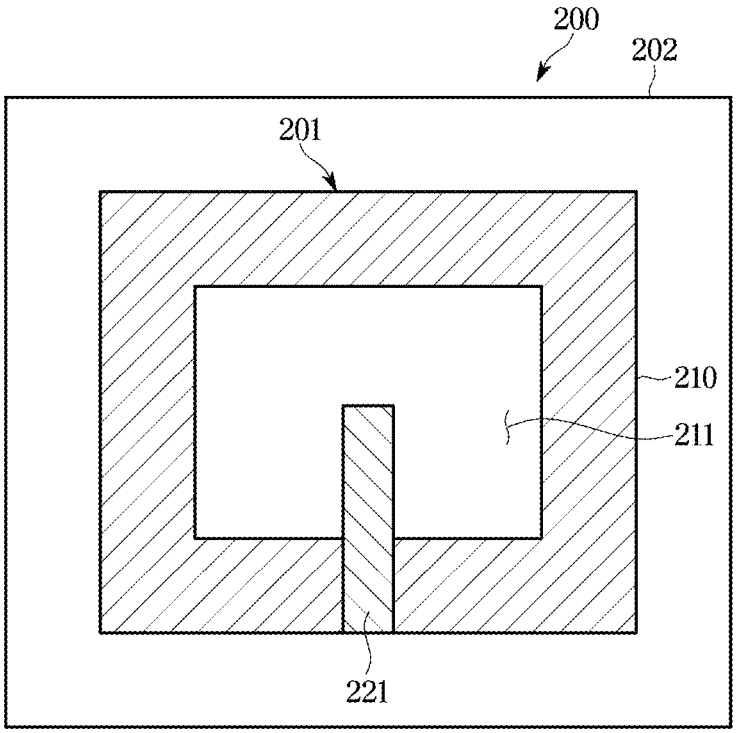

Referring to FIGS. 2*a* and 2*b*, a second antenna assembly 200 may include a second slot loop antenna 201 and a reflector 202.

The second slot loop antenna 201 includes: a loop 210 in which a slot 211 is formed; a feed pin 221 extending toward the center of the slot 211 at one side of the loop 210; a loop 210; and a dielectric 230 provided between the feed pin 221 and a loop 210. The loop 210, the slot 211, the feed pin 221 and the dielectric 230 may be identical to the loop 110, the slot 111, the feed pin 121 and the dielectric 130 shown in FIGS. 1*a* and 1*b*, therefore their description is omitted.

The reflecting plate 202 is provided in parallel with the second slot loop antenna 201 as shown in FIG. 2*a*. The reflecting plate 202 is spaced apart from the second slot loop antenna 201 by a predetermined distance D. For example, the reflecting plate 202 of the second antenna assembly 200 designed to emit electromagnetic waves of approximately 28 GHz is approximately 1.7 mm away from the second slot loop antenna 201.

The reflecting plate 202 is provided closer to the loop 210 than to the feed pin 221. In other words, the reflecting plate 202 is provided on the loop 210 side around the dielectric 230.

The reflecting plate 202 may be made of a conductive material in which an electric field is generated and a current flows when a voltage is applied.

The reflecting plate 202 may be connected to ground. Alternatively, the reflecting plate 202 may not have a potential. In other words, the reflecting plate 202 may not be electrically connected to the second antenna assembly 200.

The reflecting plate 202 may reflect electromagnetic waves emitted from the second slot loop antenna 201. As the reflecting plate 202 reflects the electromagnetic waves, the electromagnetic waves may be radiated more strongly toward the second slot loop antenna 201 based on the reflecting plate 202.

The reflecting plate 202 may be a structure separate from the second slot loop antenna 201.

For example, when the second slot loop antenna 201 is installed in a vehicle, the vehicle body of the vehicle may be a reflecting plate 202. When the second slot loop antenna 201 is installed in the door of the vehicle, the door of the vehicle may be a reflecting plate 202. When the second slot loop antenna 201 is installed in the roof of the vehicle, the loop of the vehicle may be a reflecting plate 202.

The return loss S11 of the second antenna assembly 200 is illustrated in FIG. 3. The second antenna assembly 200 may have a local minimum of return loss S11 at approximately 30 GHz and at approximately 33.5 GHz. In addition, the bandwidth of the second antenna assembly 200 may be 8.45 GHz from about 26.66 GHz-35.11 GHz based on −10 dB.

The second antenna assembly 200 having the second slot loop antenna 201 and the reflecting plate 202 may reduce the bandwidth while improving the directivity of beamforming by the reflecting plate 202.

Figure 4A:
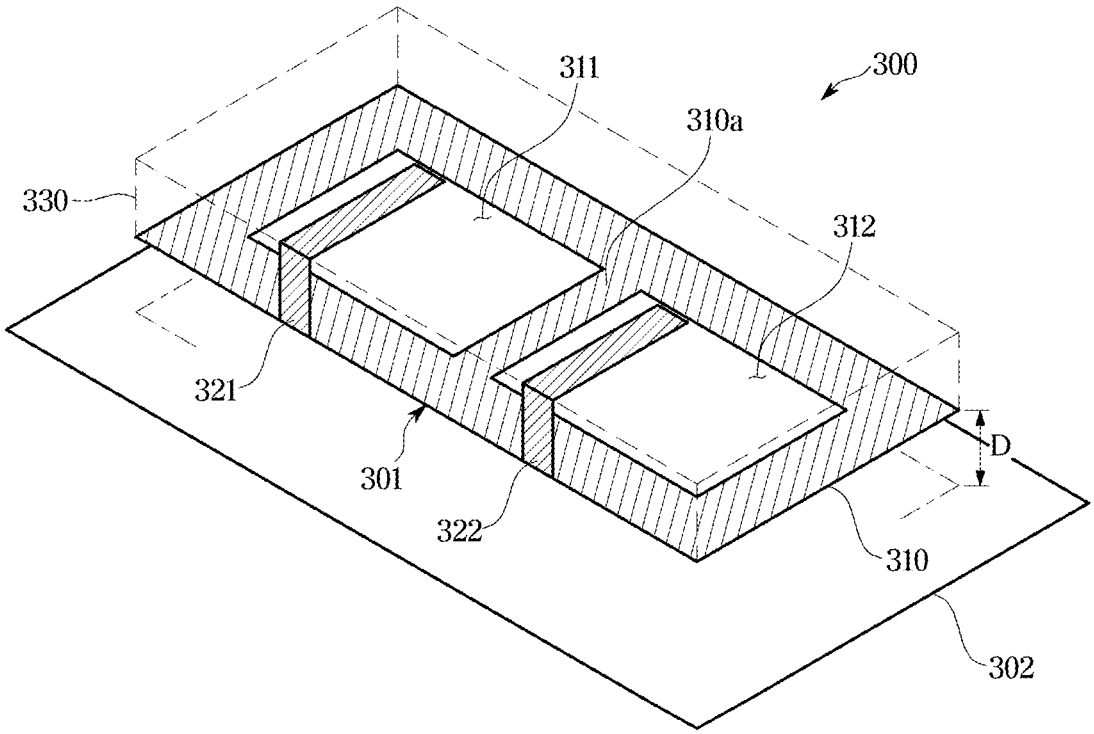
FIGS. 4*a* and 4*b* illustrate an antenna assembly including a 1×2 slot loop antenna array and a reflector according to an embodiment.
Figure 4B:
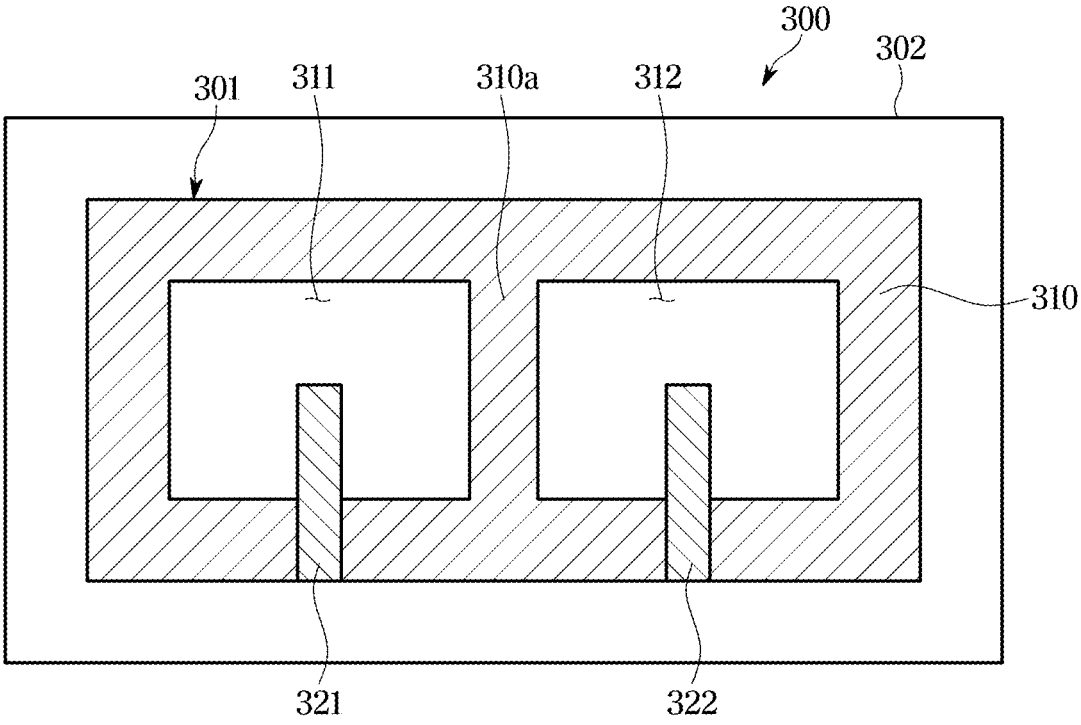
Figure 5A:
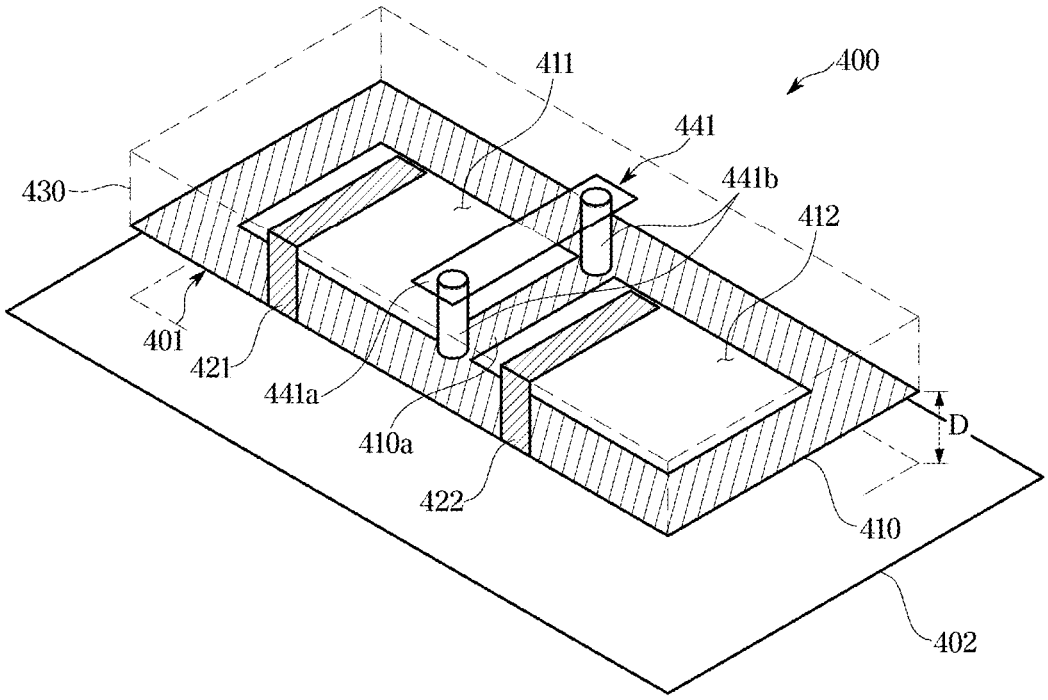
FIGS. 5*a* and 5*b* illustrate an antenna assembly including a 1×2 slot loop antenna array including a divider and a reflector according to one embodiment.
Figure 5B:
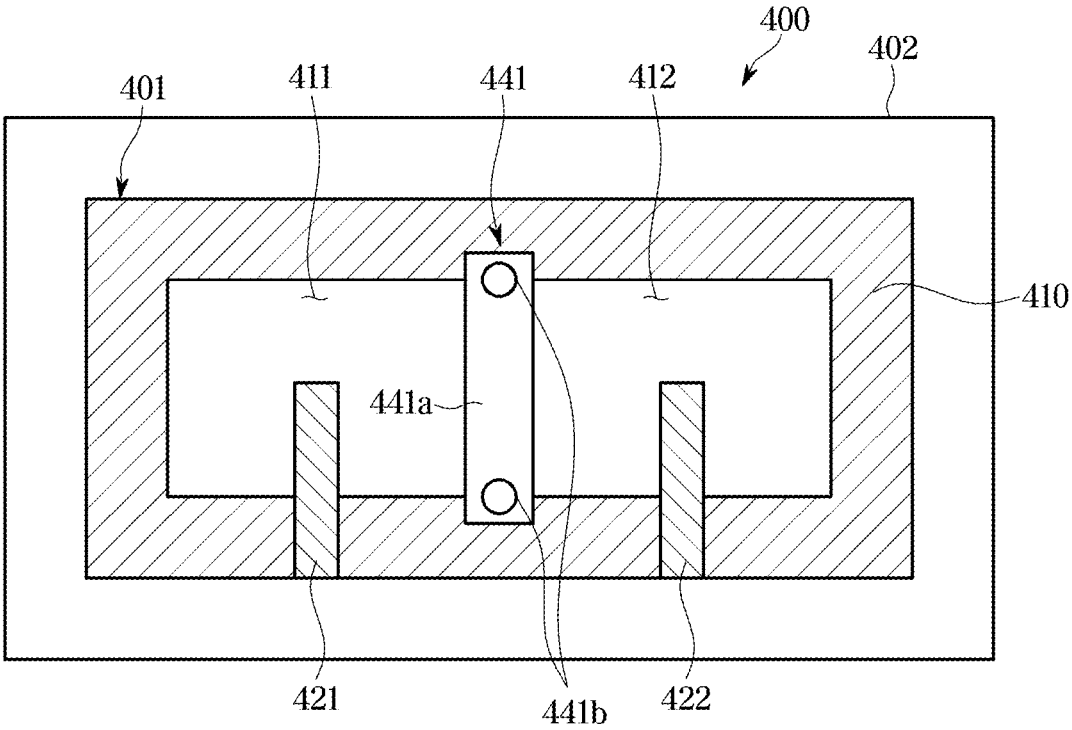
Figure 6:
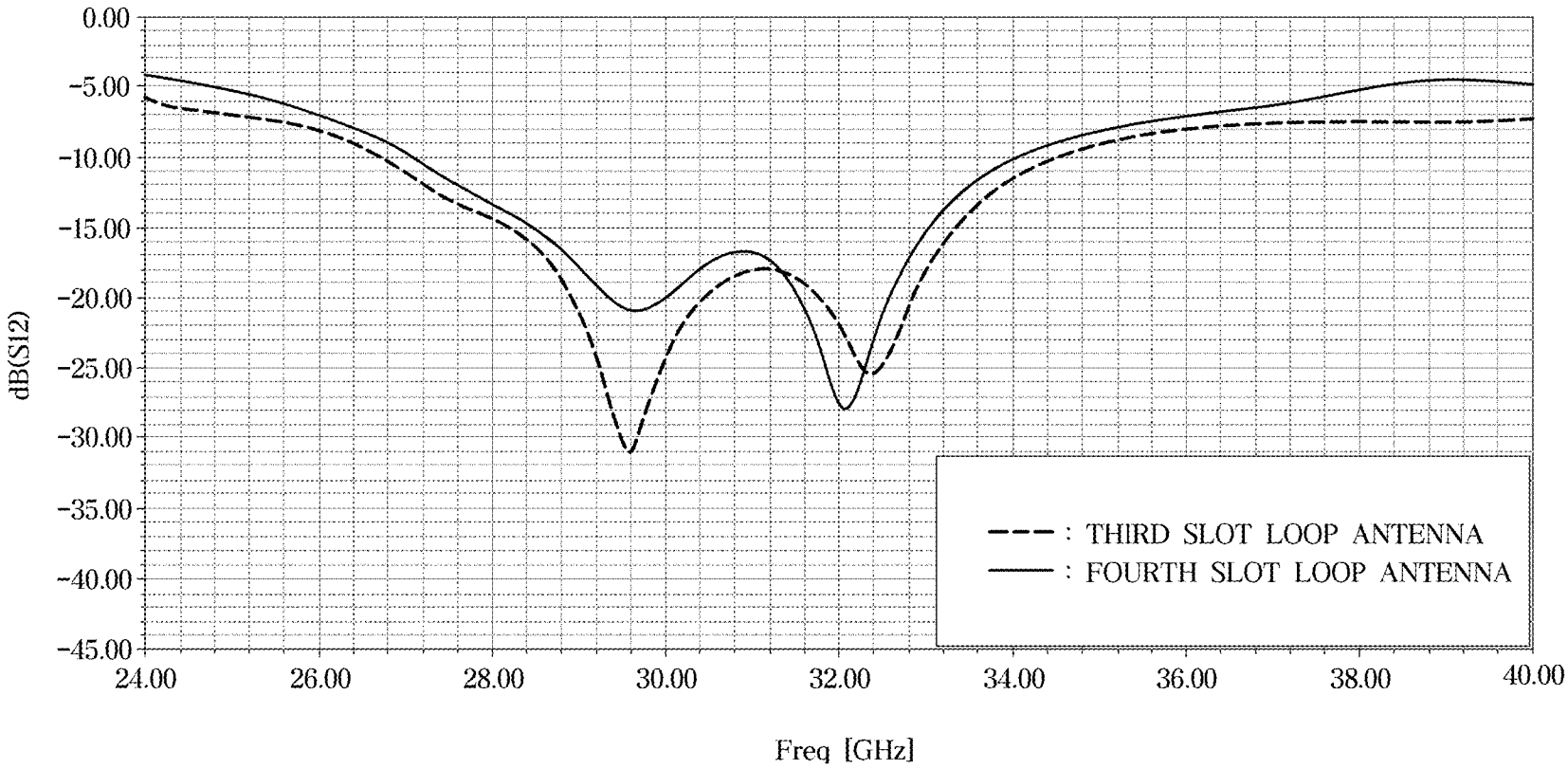
FIG. 6 shows the return loss of the antenna assembly shown in FIGS. 4*a*, 4*b*, 5*a*, and 5*b*.
Figure 7:
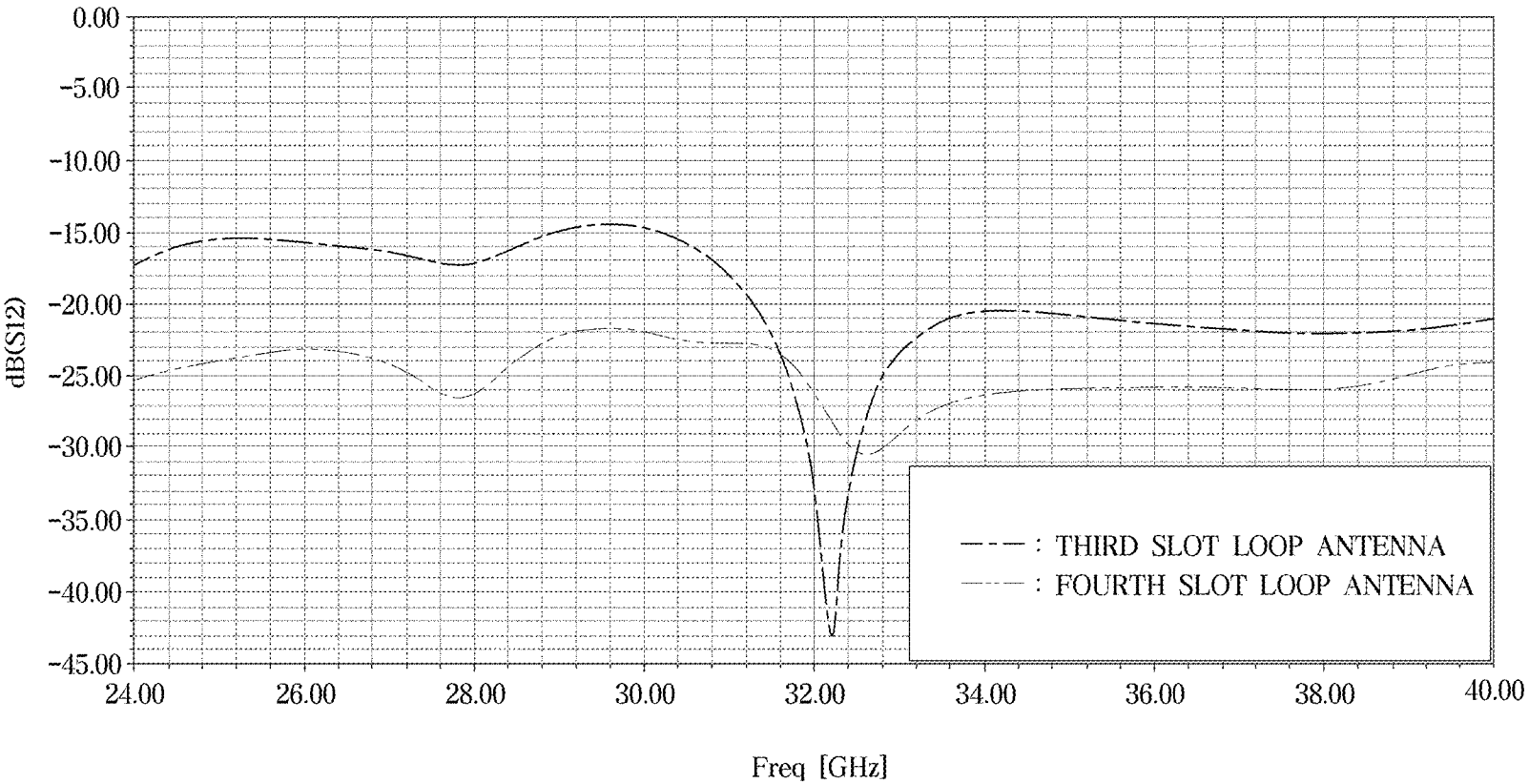
FIG. 7 shows the transfer coefficients of the antenna assembly shown in FIGS. 4*a*, 4*b*, 5*a* and 5*b*.

FIGS. 4*a* and 4*b* illustrate an antenna assembly that includes a 1×2 slot loop antenna array and a reflector according to an embodiment. FIGS. 5*a* and 5*b* illustrate an antenna assembly including a 1×2 slot loop antenna array that includes a divider and a reflector according to one embodiment. FIG. 6 shows the return loss of the antenna assembly shown in FIGS. 4*a*, 4*b*, 5*a*, and 5*b*. FIG. 7 shows the transfer coefficients of the antenna assembly shown in FIGS. 4*a*, 4*b*, 5*a*, and 5*b*.

Referring to FIGS. 4*a* and 4*b*, a third antenna assembly 300 includes a third slot loop antenna array 301 and a reflecting plate 302.

The third slot loop antenna array 301 includes: a loop 310 in which a first slot 311 and a second slot 312 are formed; a first feed pin 321 that extends toward the center of the first slot 311 at one side of the loop 310; a second feed pin 322 that extends toward the center of the second slot 312 at one side of the loop 310; and a dielectric 330 provided between the first feed pin 321 and the second feed pin 322 and the loop 310.

The loop 310 has a substantially rectangular (or square) shape as shown in FIG. 4*a*. In addition, a slot may be formed at the center of the loop 310. A partition 310*a* may be provided to partition the slot into the first slot 311 and the second slot 312.

The partition 310*a* may be manufactured integrally with the loop 310 and may be provided at approximately the center of the loop 310. Due to the partition 310*a*, the loop 310 has a shape in which pair of rectangular rings shares one side. Specifically, due to partition 310*a*, the loop 310 has a shape that approximates the digital number "8".

The slot is partitioned into a first slot 311 and a second slot 312 by the partition 310*a*. The first slot 311 and the second slot 312 are provided on the same plane. The first slot 311 and the second slot 312 may have the same size.

The partition 310*a* and the loop 310 may be made of a conductive material in which an electric field is generated and a current flows when a voltage is applied.

The dielectric 330 is provided between the first feed pin 321 and the second feed pin 322 and the loop 310 as shown in FIG. 4*a*. The dielectric 330 may be the same as the dielectric 130 shown in FIGS. 1*a* and 1*b*. Therefore, the description thereof is omitted.

The first feed pin 321 and the second feed pin 322 are provided on the dielectric 330. The first feed pin 321 and the second feed pin 322 each have a substantially rod-shaped monopole antenna shape.

The first feed pin 321 is provided at a position corresponding to the first slot 311 as shown in FIG. 4*b*. The first feed pin 321 extends toward the center of the first slot 311 from a portion adjacent to the first slot 311 of the loop 310. For example, the first feed pin 321 may extend from the bottom side of the loop 110 toward the center of the first slot 311.

The second feed pin 322 is provided at a position corresponding to the second slot 312 as shown in FIG. 4*b*. The second feed pin 322 extends toward the center of the second slot 312 from a portion adjacent to the second slot 312 of the loop 310. For example, the second feed pin 322 may extend from the bottom side of the loop 110 toward the center of the second slot 312.

The first feed pin 321 and the second feed pin 322 are arranged in parallel.

The first feed pin 321 and the second feed pin 322 may be formed of a conductive material in which an electric field is formed and a current flows when a voltage is applied.

As such, the third slot loop antenna array 301 may be a combined 1×2 antenna array with a single slot loop antenna composed of a first slot 311 and a first feed pin 321 and a single slot loop antenna composed of a second slot 312 and a second feed pin 322.

The reflecting plate 302 is provided in parallel with the third slot loop antenna array 301. The reflecting plate 302 is spaced apart from the third slot loop antenna array 301 by a predetermined distance D. The reflecting plate 302 is provided on the loop 310 side with respect to the dielectric 330. The reflecting plate 302 may reflect electromagnetic waves emitted from the third slot loop antenna array 301.

Referring to FIGS. 5*a* and 5*b*, the antenna assembly 400 includes a fourth slot loop antenna array 401 and a reflector 402.

The fourth slot loop antenna array 401 includes a loop 410 in which a first slot 411 and a second slot 412 are formed by a partition 410*a*, a first feed pin 421, and a second feed pin 422, a dielectric 430, and a divider 441.

The partition 410*a*, the first slot 411, the second slot 412, the loop 410, the first feed pin 421, the second feed pin 422, the dielectric 430; and the partition 310*a*, the first slot 311, the second slot 312, the loop 310, the first feed pin 321, the second feed pin 322, and the dielectric 330 illustrated in FIGS. 4*a* and 4*b*, respectively, may be the same, and description thereof is omitted.

The divider 441 includes a stub 441*a* provided on the dielectric 430. The stub 441*a* may be provided on the same surface as the first and the second feed pins 421 and 422.

The stub 441*a* may be provided at a position corresponding to the partition 410*a* of the loop 410. Specifically, the partition 410*a* partitions the first slot 411 from the second slot 412 at the bottom surface of the dielectric 430. The stub 441*a* may partition the first feed pin 421 from the second feed pin 422 on the top surface of the dielectric 430. The stub 441*a* is provided in parallel with the first feed pin 421 and the second feed pin 422.

The stub 441*a* may be formed of a conductive material in which an electric field is formed and a current flows when a voltage is applied.

Both ends of the stub 441*a* are provided with via holes 441*b* extending from the stub 441*a* to the loop 410 through the dielectric 430. The interior of the via holes 441*b* is filled or coated with a conductive material. Thus, the stub 441*a* may be electrically connected to the loop 410 through the via holes 441*b*.

The divider 441 comprising the stub 441*a* may isolate a slot loop antenna including a first feed pin 421 and a first slot 411 from the slot loop antenna composed of the second feed pin 422 and the second slot 412. In other words, the divider 441 may isolate the single slot antennas of the 1×2 antenna array from each other.

Therefore, it is possible to reduce the transfer coefficient between the single slot antennas included in the fourth slot loop antenna array 401.

As shown in FIG. 6, the bandwidth of the third antenna assembly 300 may be 7.84 GHz from approximately 26.72 GHz-34.56 GHz, based on −10 dB. In addition, the bandwidth of the fourth antenna assembly 400 may be 7.00 GHz from approximately 27.07 GHz-34.07 GHz based on −10 dB. As such, the bandwidth of the fourth antenna assembly 400 that includes the divider 441 is similar to the bandwidth of the third antenna assembly 300 that does not include the divider.

Compared with the bandwidth, the transfer coefficient S12 of the fourth antenna assembly 400 is smaller than the transfer coefficient S12 of the third antenna assembly 300 at most frequencies. For example, at 28 GHz, the transfer coefficient S12 of the fourth antenna assembly 400 is approximately −13 dB, while the transfer coefficient S12 of the third antenna assembly 300 is approximately −15 dB.

Larger transmission coefficients indicate greater interference between single antennas. Smaller transmission coefficients indicate that the single antennas are isolated from each other. If the isolation degree of single antennas is high, the directivity of the antenna array can be improved.

Thus, the directivity of the fourth antenna assembly 400 including the divider 441 may be improved over the directivity of the third antenna assembly 300 not including the divider.

Figure 8:
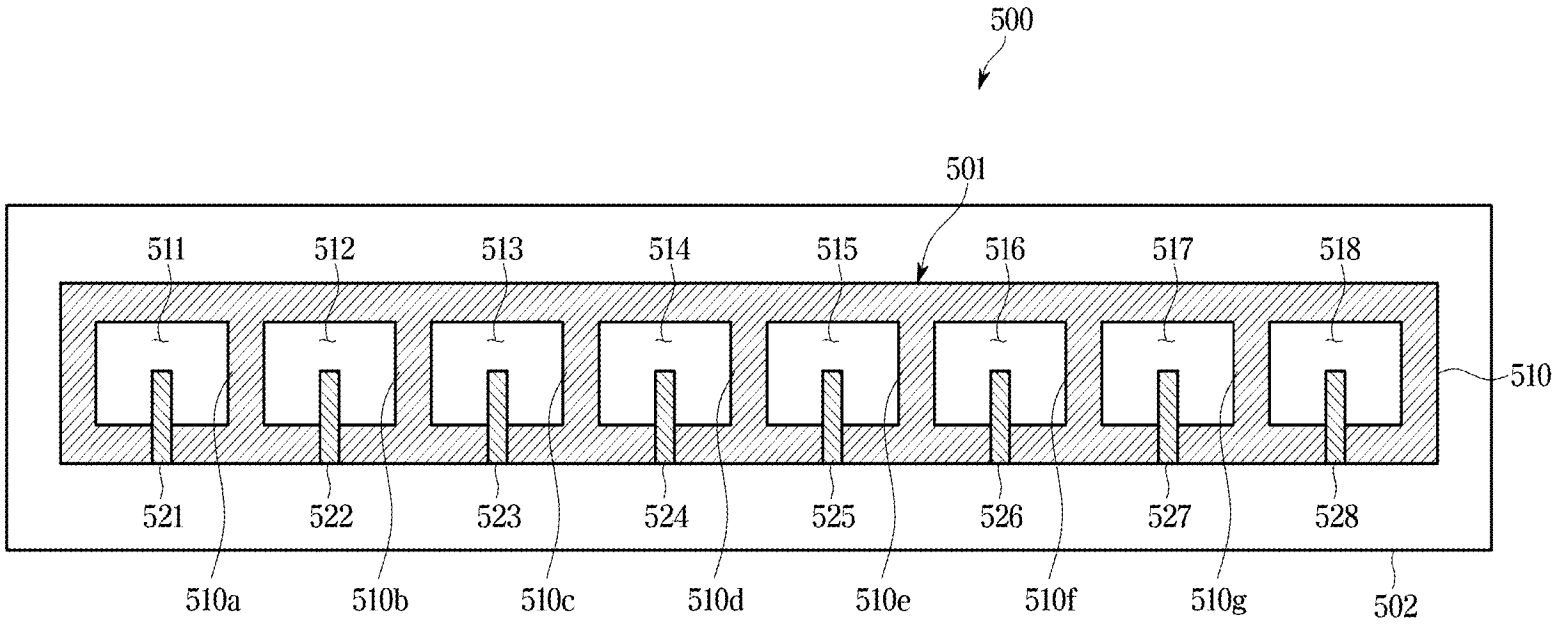
FIG. 8 illustrates a 1×8 slot loop antenna arrangement according to an embodiment.
Figure 9:
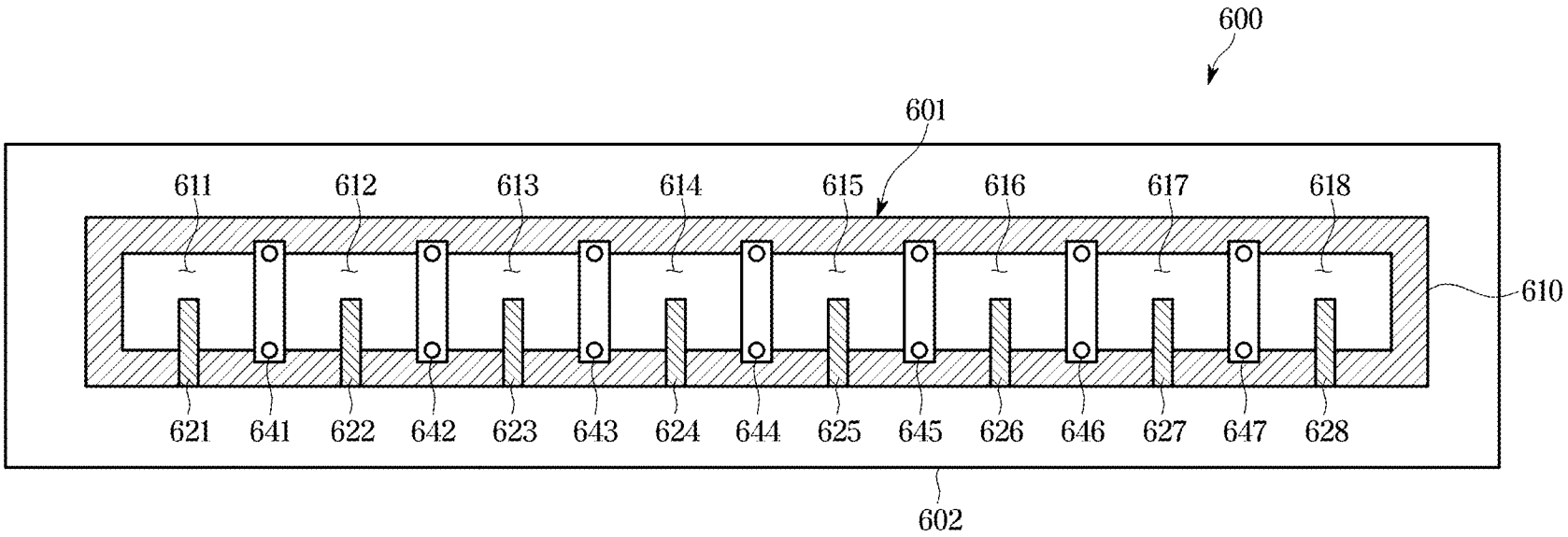
FIG. 9 illustrates a 1×8 slot loop antenna arrangement including a divider according to an embodiment.
Figure 10:
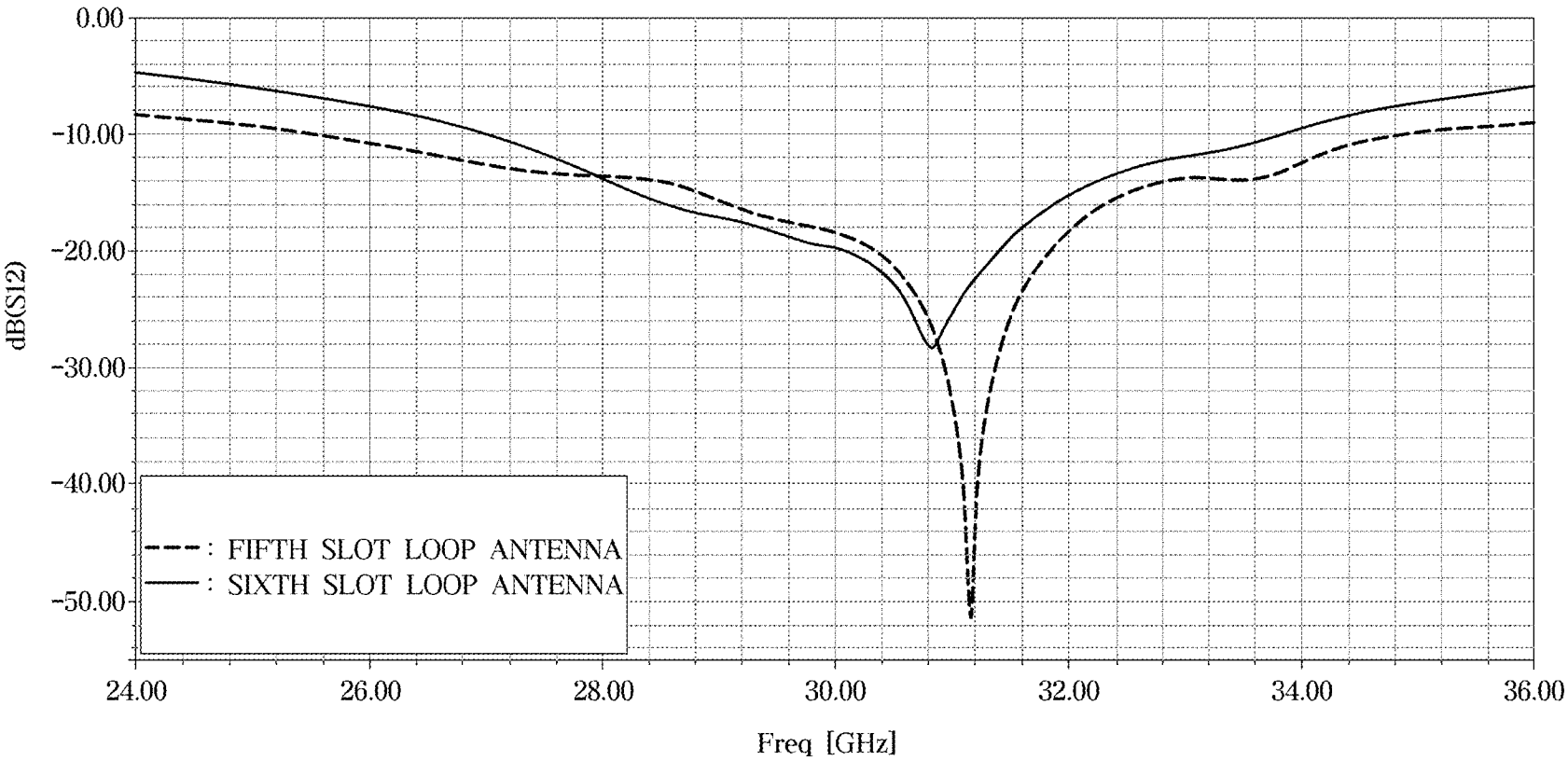
FIG. 10 shows the return loss of the 1×8 slot loop antenna arrangement shown in FIGS. 8 and 9.
Figure 11:
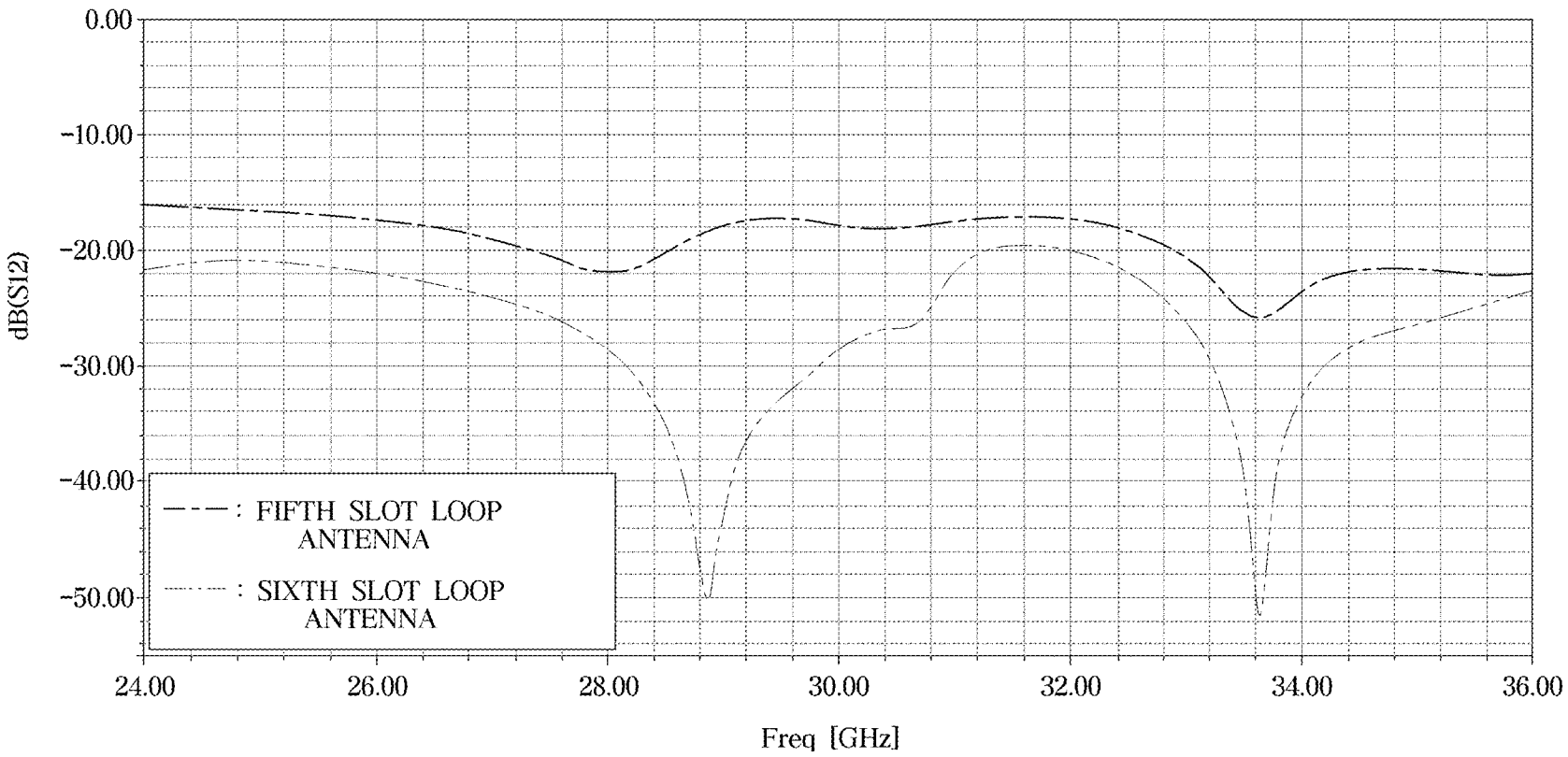
FIG. 11 shows the transfer coefficients of the 1×8 slot loop antenna arrangement shown in FIGS. 8 and 9.

FIG. 8 illustrates a 1×8 slot loop antenna arrangement according to an embodiment. FIG. 9 illustrates a 1×8 slot loop antenna arrangement including a divider according to an embodiment. FIG. 10 shows the return loss of the 1×8 slot loop antenna arrangement shown in FIGS. 8 and 9. FIG. 11 shows the transfer coefficients of the 1×8 slot loop antenna arrangement shown in FIGS. 8 and 9.

Referring to FIG. 8, a fifth antenna assembly 500 includes an antenna array 501 and a reflecting plate 502.

The fifth slot loop antenna array 501 includes a loop 510, first to eighth feed pins 521-528, and a dielectric.

First to eighth slots 511-518 are formed inside the loop 510. The first to eighth slots 511-518 are partitioned by the first to seventh partitions 510*a*-510*g*. In detail, the interior of the loop 510 is partitioned into first to eighth slots 511-518 by the first to seventh partitions 510*a*-510*g*. The first to eighth slots 511-518 may have the same size.

Although not shown in the drawings, a dielectric is provided between the feed pins 521-528 and the loop 510.

First to eighth feed pins 521-528 are provided on the dielectric. Each of the first to eighth feed pins 521-528 has a shape of a substantially monopole antenna.

The first to eighth feed pins 521-528 are provided at positions corresponding to the first to eighth slots 511-518, respectively.

As such, the fifth slot loop antenna array 501 may be a 1×8 antenna array having first to eighth feed pins 521-528 and first to eighth slots 511-518.

Referring to FIG. 9, a sixth antenna assembly 600 includes a sixth slot loop antenna array 601 and a reflecting plate 602.

The sixth slot loop antenna array 601 includes a loop 610, first to eighth feed pins 621-628, a dielectric, and first to seventh dividers 641-647.

First to eighth slots 611-618 are formed inside the loop 610. The first-eighth slots 611-618 are partitioned by the first to seventh partitions.

The first to eighth feed pins 621-628 are provided on the dielectric. Each of the first to eighth feed pins 621-628 is provided at a position corresponding to the first to eighth slots 611-618.

The sixth slot loop antenna array 601 may be a 1×8 antenna array that has first to eighth feed pins 621-628 and first to eighth slots 611-618.

The first to seventh dividers 641-647 are provided on the dielectric, respectively, and are provided between the feed pins 621-628.

The first to seventh dividers 641-647 each include stubs provided on the dielectric and via holes that extend from the end of the stubs to the loop 610 through the dielectric. The stubs may be electrically connected to the loop 610 through via holes.

The first to seventh dividers 641-647 may isolate the single slot antennas of the 1×8 antenna array from each other.

Thereby, the transmission coefficient between the single slot antenna included in the sixth slot loop antenna array 601 can be reduced.

As shown in FIG. 10, the bandwidth of the fifth antenna assembly 500 may be 9.34 GHz from approximately 25.53 GHz to 34.87 GHz based on −10 dB. In addition, the bandwidth of the sixth antenna assembly 600 may be 6.87 GHz from approximately 27.00 GHz to 33.87 GHz based on −10 dB. As such, the bandwidth of the sixth antenna assembly 600 including the first through seventh dividers 641-647 is somewhat smaller than the bandwidth of the fifth antenna assembly 500 without the divider.

As shown in FIG. 11, in comparison to the bandwidth, the transfer coefficient S12 of the sixth antenna assembly 600 is smaller than the transfer coefficient S12 of the fifth antenna assembly 500 at most frequencies. For example, at 28 GHz, the transfer coefficient S12 of the sixth antenna assembly 600 is approximately −30 dB, while the transfer coefficient S12 of the fifth antenna assembly 500 is approximately −22 dB.

Larger transmission coefficients indicate greater interference between single antennas. Smaller transmission coefficients indicate that the single antennas are isolated from each other. If the isolation degree of single antennas is high, the directivity of the antenna array can be improved.

Accordingly, the directivity of the sixth antenna assembly 600 including the first to seventh dividers 641-647 may be best improved than the directivity of the fifth antenna assembly 500 including no divider.

Figure 12:
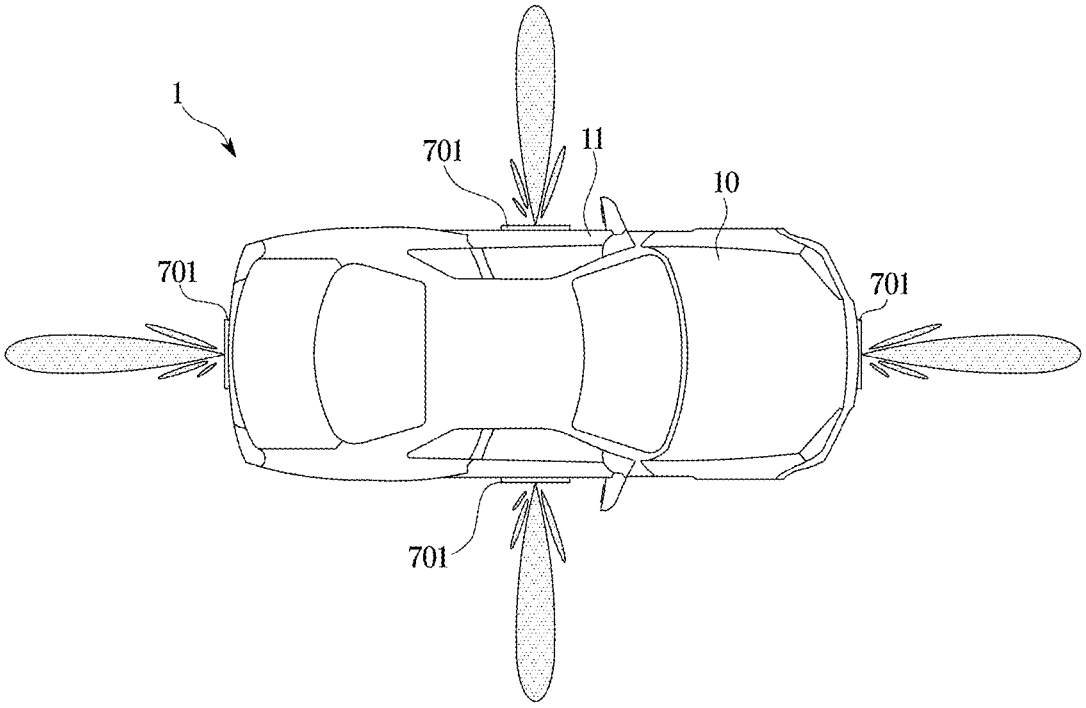
FIG. 12 shows a vehicle equipped with a 1×8 slot loop antenna arrangement.

FIG. 12 shows a vehicle equipped with a 1×8 slot loop antenna arrangement.

The vehicle 1 has a chassis which forms its exterior and contains a vehicle body 10 for accommodating the driver and/or baggage. The chassis comprises components of the vehicle 1 other than the vehicle body 10 and electric devices that protect and provide convenience to the driver.

The vehicle body 10 of the vehicle 1 is provided with a 1×8 slot loop antenna array 701. The slot loop antenna array 701 includes a divider.

A 1×8 slot loop antenna array 701 may be installed in the door 11 to communicate with a communication infrastructure installed on the side of the lane. In addition, a 1×8 slot loop antenna arrangement 701 may be installed in front and/or rear of the vehicle body 10 to communicate with the preceding and/or trailing vehicles of the vehicle 1.

The 1×8 slot loop antenna array 701 may use the door 11 or the vehicle body 10 of the vehicle 1 as a reflector. The 1×8 slot loop antenna array 701 is spaced apart from the door 11 or the vehicle body 10 by a predetermined distance.

As is apparent from the above, an antenna array can provide a wideband high gain characteristic.

What is claimed is:

1. An antenna array comprising:
a dielectric;
a loop provided on a first surface of the dielectric and having a first slot and a second slot;
a first feed pin provided at a position corresponding to the first slot on a second surface of the dielectric;
a second feed pin provided at a position corresponding to the second slot on the second surface of the dielectric; and
a divider provided between the first feed pin and the second feed pin, and electrically connected to the loop,
wherein the divider includes a stub provided between the first feed pin and the second feed pin on the second surface of the dielectric.

2. The antenna array of claim 1, wherein the divider further comprises:
via holes extending from both ends of the stub to the loop through the dielectric.

3. The antenna array of claim 2, wherein the loop includes a partition partitioning the first slot and the second slot.

4. The antenna array of claim 3, wherein the stub is provided at a position corresponding to the partition.

5. The antenna array of claim 1, wherein the first feed pin extends from a first point corresponding to the loop toward center of the first slot, and the second feed pin extends from a second point corresponding to the loop toward center of the second slot.

6. The antenna array of claim 5, wherein the first feed pin and the second feed pin are disposed in parallel with each other.

7. The antenna array of claim 6, wherein the stub is provided in parallel with the first feed pin and the second feed pin.

8. An antenna array comprising:
a dielectric;
a first antenna including a first loop provided on a lower surface of the dielectric and having a first slot formed thereon, and a first feed pin provided on an upper surface of the dielectric and provided at a position corresponding to the first slot;
a second antenna including a second loop provided on a lower surface of the dielectric and having a second slot formed thereon, and a second feed pin provided on an upper surface of the dielectric and provided at a position corresponding to the second slot; and
a divider separating the first antenna and the second antenna,
wherein at least a portion of the first loop is shared with at least a portion of the second loop, and
wherein the divider includes a stub provided between the first feed pin and the second feed pin on the second surface of the dielectric.

9. The antenna array of claim 8, wherein the divider further comprises:
via holes extending from both ends of the stub to the first loop and the second loop through the dielectric.

10. The antenna array of claim 8, wherein the stub is provided at a position where the first loop and the second loop are shared.

11. The antenna array of claim 8, wherein the first feed pin extends from a first point corresponding to the loop toward center of the first slot, and the second feed pin extends from a second point corresponding to the loop toward center of the second slot.

12. The antenna array of claim 11, wherein the first feed pin and the second feed pin are disposed in parallel with each other.

13. The antenna array of claim 12, wherein the stub is provided in parallel with the first feed pin and the second feed pin.

14. A vehicle comprising:
a vehicle body; and
an antenna array spaced apart from the vehicle body by a predetermined distance, wherein
the antenna array includes
a dielectric,
a loop provided on a first surface of the dielectric and having a first slot and a second slot,
a first feed pin provided at a position corresponding to the first slot on a second surface of the dielectric,
a second feed pin provided at a position corresponding to the second slot on the second surface of the dielectric, and
a divider provided between the first feed pin and the second feed pin, and electrically connected to the loop.

15. The vehicle of claim 14, wherein the divider comprises:
a stub provided between the first feed pin and the second feed pin on the second surface of the dielectric; and
via holes extending from both ends of the stub to the loop through the dielectric.

16. The vehicle according to claim 15, wherein the loop includes a partition partitioning the first slot and the second slot.

17. The vehicle according to claim 16, wherein the stub is provided at a position corresponding to the partition.

18. The vehicle according to claim 14, wherein the first feed pin extends from a first point corresponding to the loop toward center of the first slot, and the second feed pin extends from a second point corresponding to the loop toward center of the second slot.

* * * * *